US008253548B2

(12) United States Patent
Oh et al.

(10) Patent No.: US 8,253,548 B2
(45) Date of Patent: Aug. 28, 2012

(54) ELEVATOR SYSTEM WITH WIRELESS HALL CALL BUTTONS

(75) Inventors: Jae-Hyuk Oh, Tolland, CT (US); Norbert A. M. Hootsmans, South Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 589 days.

(21) Appl. No.: 11/991,342

(22) PCT Filed: Sep. 7, 2005

(86) PCT No.: PCT/US2005/031629

§ 371 (c)(1),
(2), (4) Date: Apr. 6, 2009

(87) PCT Pub. No.: WO2007/030109

PCT Pub. Date: Mar. 15, 2007

(65) Prior Publication Data

US 2009/0295550 A1 Dec. 3, 2009

(51) Int. Cl.
*G07C 11/00* (2006.01)

(52) U.S. Cl. ..... 340/286.06; 49/13; 187/395; 294/102.2

(58) Field of Classification Search ..... 340/286.01–286.09, 287, 291; 187/247, 391, 393, 395, 187/396, 399; 49/13, 31; 294/102.2; 405/303
See application file for complete search history.

(56) References Cited

U.S. PATENT DOCUMENTS

| | | | | |
|---|---|---|---|---|
| 4,685,536 | A * | 8/1987 | Ichioka | 187/247 |
| 5,231,326 | A * | 7/1993 | Echols | 310/339 |
| 6,601,679 | B2 * | 8/2003 | Crenella et al. | 187/395 |
| 6,986,408 | B2 * | 1/2006 | Takeuchi | 187/380 |
| 7,380,641 | B2 * | 6/2008 | Dos Santos | 187/395 |
| 7,479,861 | B2 * | 1/2009 | Zepke et al. | 336/178 |
| 7,985,971 | B2 * | 7/2011 | Cai et al. | 257/79 |
| 2003/0057030 | A1 * | 3/2003 | Yumura et al. | 187/394 |
| 2003/0116385 | A1 * | 6/2003 | Valk et al. | 187/391 |
| 2006/0207837 | A1 | 9/2006 | Zepke et al. | |
| 2008/0041669 | A1 * | 2/2008 | Sansevero et al. | 187/389 |

(Continued)

FOREIGN PATENT DOCUMENTS

| | | | |
|---|---|---|---|
| JP | 3046979 | A | 2/1991 |
| JP | 2001151429 | A | 6/2001 |

(Continued)

OTHER PUBLICATIONS

The First Office Action of the Chinese Intellectual Property Office in counterpart foreign application No. 200580051510.0 filed Sep. 7, 2005.

(Continued)

*Primary Examiner* — George Bugg
*Assistant Examiner* — Edny Labbees
(74) *Attorney, Agent, or Firm* — Kinney & Lange, P.A.

(57) ABSTRACT

An elevator system (10) includes a wireless batteryless hall call switch module (22) that transmits a unique wireless code when a person presses a hall call button (32, 34) requesting elevator service. A hall indicator module (24) includes an RF transceiver (64) that receives the wireless code from the switch module (22), activates a display to indicate that a button has been pushed, and transmits the hall call information to the elevator control system (14). When the elevator controller (14) informs the transceiver (64) of car arrival, the hall indicator module (24) causes the display to indicate car arrival.

18 Claims, 3 Drawing Sheets

U.S. PATENT DOCUMENTS

2009/0294221 A1* 12/2009 Bahjat et al. ..... 187/396
2010/0294599 A1 11/2010 Zepke et al.

FOREIGN PATENT DOCUMENTS

JP 2005096878 A 4/2005
JP 2005130395 A 5/2005
WO WO 00/34169 6/2000
WO 2005005299 A1 1/2005

OTHER PUBLICATIONS

PCT International Preliminary Report—Written Opinion, Mar. 3, 2009, 6 pages.
Japanese Patent Office, Office Action, Sep. 6, 2011, 2 pages.

* cited by examiner

ELEVATOR SYSTEM WITH WIRELESS HALL CALL BUTTONS

BACKGROUND OF THE INVENTION

The present invention relates to elevator systems. In particular, the present invention is an elevator system having wireless hall call buttons.

In a typical elevator system hall call buttons are used by passengers to request elevator service. The hall call buttons are usually positioned on a wall adjacent the elevator doors. Most hall call buttons have an associated lamp which turns on (illuminates one or more hall call buttons) when the person presses the button to call the elevator. The elevator controller turns the lamp off when the elevator car arrives at the floor.

Typical elevator systems also have hall lanterns or displays that indicate when an elevator car has arrived, and may also indicate the current location of the car. A typical hall lantern includes up and down arrows or triangles, and is located at the upper part of the hoistway door for better visibility. One of the two triangles is lit when a car arrives, depending upon the direction in which the car will be traveling when it departs.

BRIEF SUMMARY OF THE INVENTION

The elevator system of the present invention includes a wireless hall call switch module including a hall call button and a wireless transmitter that is powered by actuation of the button to transmit a hall call signal. A hall lantern module performs both the button indication and hall indication functions. The hall lantern module includes an RF transceiver that receives the wireless hall call signal, transmits hall call information to the elevator controller and receives car arrival information from the controller. The transceiver controls operation of the hall lantern module to provide both button indication and hall indication functions based upon signals from the hall call switch module and the elevator controller.

DETAILED DESCRIPTION

Figure 1:
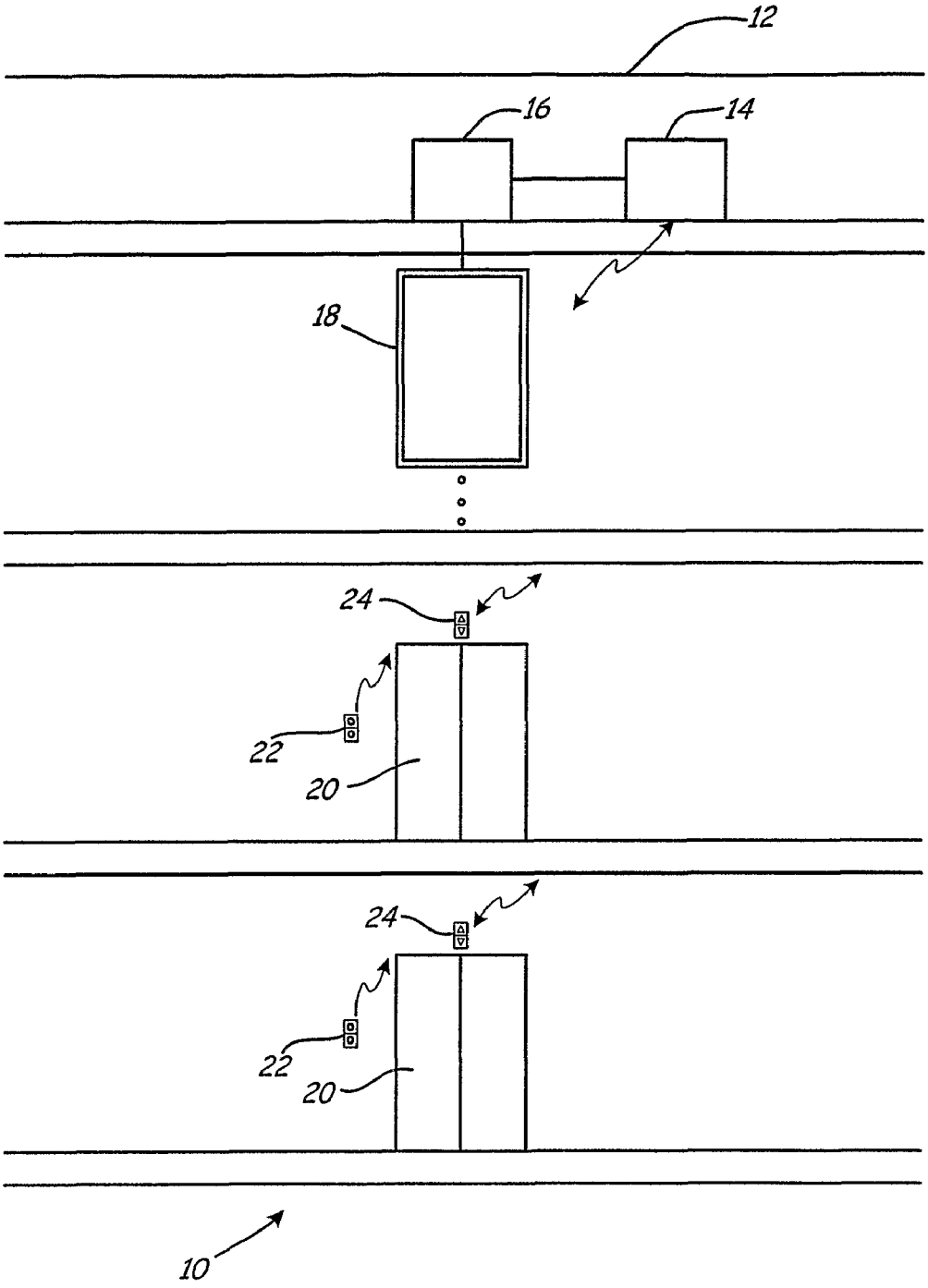
FIG. 1 shows an elevator system including a wireless batteryless hall call switch module and a hall lantern module.

FIG. 1 shows elevator system 10 in building 12. Elevator system 10 includes elevator control 14, elevator drive system 16 and elevator car 18. At each floor, elevator doors 20, hall call switch module 22, and hall lantern module 24 are shown. Hall call switch module 22 is a batteryless wireless device which transmits a unique wireless code when a person presses either the up or down button. The energy required for the wireless transmission is generated by a piezo electric power generator in switch module 22.

Hall lantern module 24 is an indicator module that performs both a button indication and a hall indication function. In other words, it provides a elevator status information whenever an up or down button on hall call switch module 22 has been pressed. That status information is provided until an elevator car 18 has arrived. At that time, hall lantern module 24 provides elevator status information indicating that car 18 has arrived and indicating the direction in which car 18 will be traveling. In order to provide such status information, hall lantern module 24 includes a display that can be visual (e.g., an LCD, LED, or other lighted display), audible, or tactile (e.g., a Braille display).

In addition, the display provided by hall lantern module 24 may also include an indication of the location (i.e. current floor) of elevator 18. This is particularly desirable at the first or lobby floor.

Hall lantern module 24 communicates wirelessly with both hall call switch module 22 and elevator control 14. Upon receiving and recognizing a unique code transmitted by switch module 22, hall lantern module 24 activates a display to indicate which button has been pressed. It also routes the code from switch module 22 wirelessly to control 14 using an antenna that protrudes into the elevator hoistway. The transmission from module 24 may be a single hop (i.e. directly from hall lantern module 24 to elevator control 14) or may be multi-hop (i.e. from one hall lantern module to another until the code reaches elevator 14). In that respect, hall lantern module 24 can be understood as a wireless node capable of receiving, displaying, and transmitting elevator status information in a wireless sensor/device network.

Elevator control 14 schedules movement of elevator car 18 and provides necessary control signals to elevator drive 16. In the simplified diagram shown in FIG. 1, only a single elevator is shown, but in other systems elevator control 14 may control the dispatching and movement of a group of elevators.

When car 18 approaches the particular floor that has requested service, elevator control 14 sends a wireless message to hall lantern module 24 associated with that floor. Upon being notified of car arrival, hall lantern module 24 turns off the button lamp and turns on the hall lantern to indicate car arrival. Elevator control 14 also may send wireless messages containing car location information to modules 24 so that the current location of car 18 can also be displayed.

Elevator system 10 avoids the need to connect hall lantern modules 24 to elevator controller 14, since communication is performed wirelessly. This leads to savings due to a simpler interface on controller 14, and fewer wires connected to elevator controller 14.

The use of batteryless wireless hall call switch modules 22 eliminates the need for any wiring to hall call switch modules 22. No power is required to module 22, because it generates its own power for transmission of the coded message to hall lantern module 24, and the buttons on switch module 22 do not light. Instead, the button lamp indicator function is performed by hall lantern module 24. Nor are wires required for communication between modules 22 and 24, since the communication is performed wirelessly.

Because no wiring is required for hall call switch module 22, the time and expense required to drill a hole through the hoistway wall and install and wire hall call buttons is eliminated. In addition, much greater flexibility in the location of the hall call switch module is possible, because no wiring is required as long as switch module 22 is close enough to hall lantern module 24 so that its wireless transmission is received. This allows simplified installation of switch module 22 at greater distances from elevator doors 20 to allow for early elevator calling. In addition, mobile hall call button capability can be provided for frequent users and very important persons, because there is no requirement that module 22 be wired or even attached to building 10. It is also possible for elevator control 14 to automatically set the destination for a user of a mobile switch module by recognizing the unique ID from that particular module.

Figure 2:
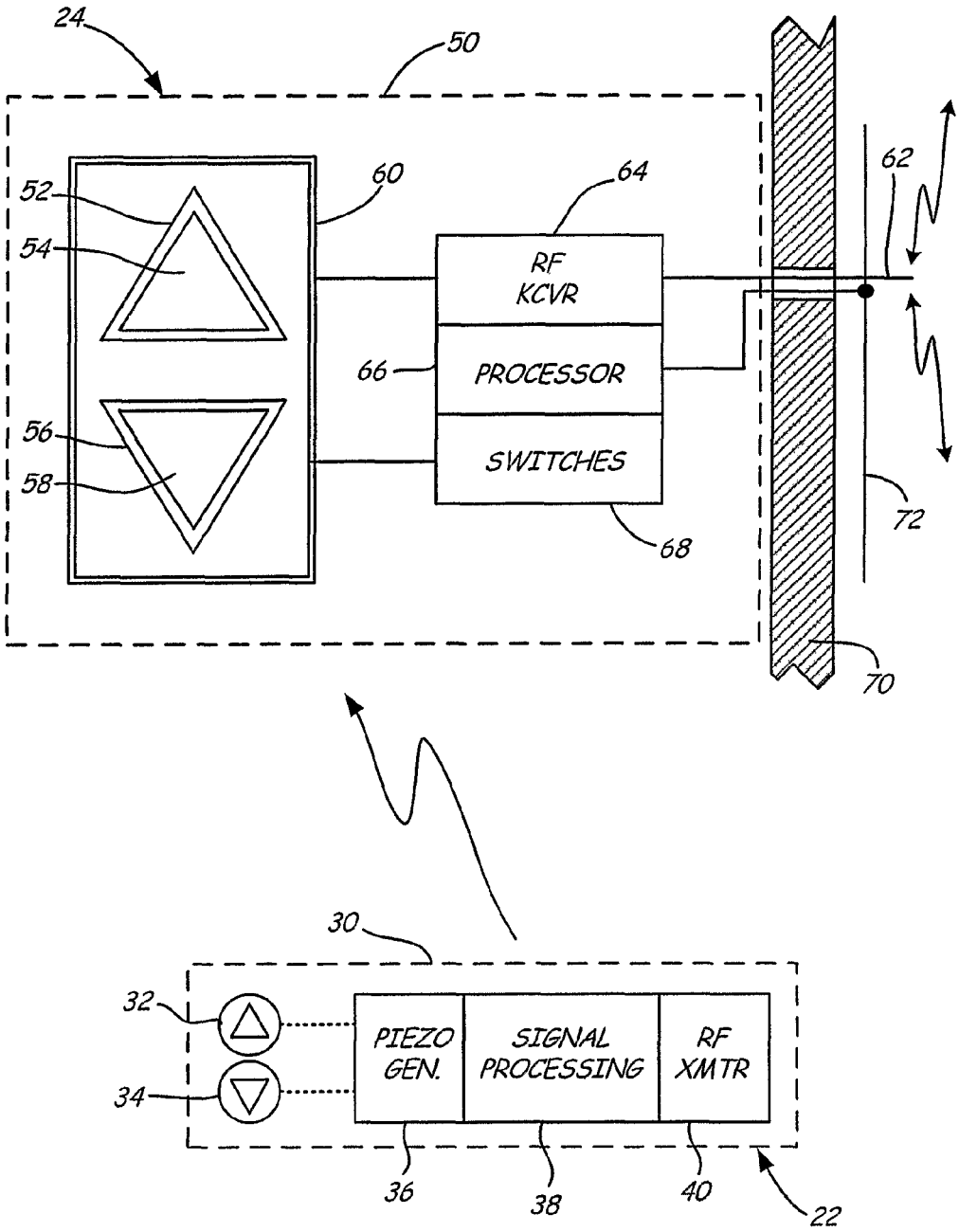
FIG. 2 is a block diagram showing the hall call switch module and hall lantern module of the system of FIG. 1.

FIG. 2 is a block diagram illustrating hall call switch module 22 and hall lantern module 24 in further detail.

Hall call switch module 22 includes housing 30, up button 32, down button 34, piezoelectric generators 36, signal processing circuitry 38, and RF transmitter 40. Switch module 22 is both batteryless and wireless. All power for signal processing circuitry 38 and RF transmitter 40 is derived from piezoelectric generators 36, which are actuated by pressing of buttons 32 and 34. Batteryless, wireless switch modules are available from, for example, EnOcean GmbH, Obeshaching Germany. Further description of these types of switches can be found in Gerlach et al. U.S. Pat. No. 6,747,573 and Albsmeier et al. U.S. Patent Application No. US 2005/0073221.

Hall lantern module 24 includes housing 50, up button lamp 52, up hall lantern 54, down button lamp 56, down hall lantern 58, antennas 60 and 62, RF receiver 64, processor 66, and switches 68. Housing 50 is mounted on hoistway wall 70. Electrical power for hall lantern module 50 is provided from power line 72 which extends along the interface of hoistway wall 70.

Antenna 60 is located within housing 50 of hall lantern module 24 to receive wireless communications from RF transmitter 40 of switch module 22. Energy received by antenna 60 is provided to RF transceiver 64, which, together with processor 66, decodes the RF signal and determines the source of the signal and whether up button 32 or down button 34 have been pressed.

Based upon receiving either an up or down button press signal, processor 66 controls switches 68 to turn on either up button lamp 52 or down button lamp 56. In the embodiment shown in FIG. 2, button lamps 52 and 56 surround the triangular hall lanterns 54 and 58, respectively.

Processor 66 also causes RF transceiver 64 to transmit a signal on antenna 62. This signal identifies the source of the hall call request, and whether the passenger desires to travel up or down in elevator 18. Antenna 62 extends through an opening in hoistway wall 70 and into the hoistway.

The button lamp 52 or 56 remains lit until elevator controller 14 sends a wireless signal back to hall lantern module 24 indicating that a car is about to arrive and the direction in which the car will be traveling. The wireless signal from elevator controller 14 is received at antenna 62 and decoded by RF transceiver 64 and processor 66. Processor 66 then controls switches 68 to turn off button lamp 52 or 56, and to turn on the appropriate hall lantern 54 or 58.

Once the elevator doors are closed and car 18 has departed, antenna 62 will receive another transmission from elevator control 14 indicating that the car has departed. The transmission is decoded by transceiver 64 and processor 66, and switches 68 are reset to turn off all lantern module 24 is then back in a ready state, waiting a next transmission from module 22 or from elevator control 14.

FIGS. 3A-3D illustrates the sequence of operation of hall lantern module 24 in providing a display with both button indication and hall indication functions. In the exemplary embodiment shown in FIGS. 3A-3D, the display provides visual outputs; however, other forms of outputs are possible. In FIGS. 3A-3D, button lamp 52 and hall lantern 54 are shown for the purposes of this example. The operation of button lamp 56 and hall lantern 58 is similar.

Figure 3A:
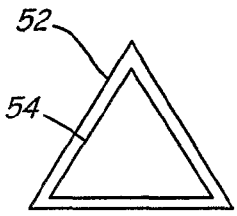
FIGS. 3A-3D illustrates operation of the hall lantern module progressing through "ready", "up button pressed" "car arrived", and back to "ready" states, respectively.

In FIG. 3A, hall lantern module 24 is in a ready state, awaiting a signal from either switch module 22 or elevator control 14. Both button lamp 52 and hall lantern 54 are off.

Figure 3B:
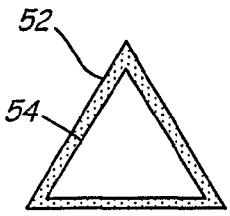

In FIG. 3B, lantern module 24 has received a wireless transmission from switch module 22 indicating that up button 32 has been pressed. As a result, button lamp 52 is turned on, while hall lantern 54 remains off.

Figure 3C:
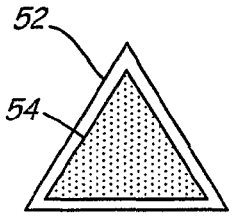

When car 18 arrives, lantern module 24 receives a signal from elevator control 14. This causes button lamp 52 to turn off, and hall lantern 54 to turn on, as illustrated in FIG. 3C.

Figure 3D:
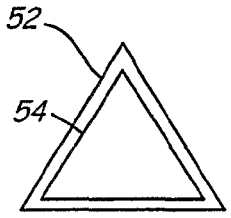

After car 18 departs, hall lantern 24 receives communication from elevator control 14. As a result, hall lantern 54 is turned off. As shown in FIG. 3D, lamp 52 and hall lantern 54 are both off, and lantern module 24 is back in a ready state like that shown in FIG. 3A.

FIG. 2 and FIGS. 3A-3D show one possible arrangement of button lamps and hall lanterns together in hall lantern module 24. Other shapes and configurations are also possible. For instance, hall lanterns can be provided that surround button lamps. By providing both button lamps and hall lanterns in the same lantern module, and eliminating the need for the button lamp in switch module 22, the need for wiring or a battery in switch module 22 is eliminated. This greatly simplifies installation, offers a variety of different placements for switch module 22, and simplifies the cost and time required for installing switch modules 22 as well as hall lantern modules 24.

Although the present invention has been described with reference to preferred embodiments, workers skilled in the art will recognize that changes may be made in form and detail without departing from the spirit and scope of the invention.

The invention claimed is:

1. An elevator call system comprising:

a hall call switch module including a hall call button, a pressure responsive power generator, and a wireless transmitter powered by the power generator as a result of pressure applied by actuation of the button to transmit a hall call signal; and a hall lantern module mounted on a hoistway wall, the hall lantern module including a display that includes up and down button indicators and up and down hall car arrival indicators; an antenna; an RF transceiver connected to the antenna for wirelessly receiving the hall call signal from the wireless transmitter of the hall call switch, wirelessly transmitting hall call information to an elevator control system, and wirelessly receiving elevator location information from the elevator control system; and a processor for controlling operation of the up and down button indicators of the display based upon the hall call signal and the up and down hall car arrival indicators of the display based upon the elevator location information, wherein the hall lantern module is physically spaced from the hall call switch module and has no wired connection to the hall call switch module.

2. The system of claim 1 wherein the hall call switch includes a piezoelectric generator responsive to actuation of the button.

3. The system of claim 1, wherein the up button indicator is adjacent the up hall car arrival indicator, and the down button indicator is adjacent the down hall car arrival indicator.

4. The system of claim 3, wherein the up button indicator surrounds the up hall car arrival indicator, and the down button indicator surrounds the down hall car arrival indicator.

5. An elevator call system comprising:

an elevator control system capable of providing an elevator position signal;

a hall call switch module comprising:

at least on actuatable hall call button;

a wireless transmitter; and a power generator capable of generating electrical power as a result of pressure applied to the power generator by actuation of a first of the at least one hall call buttons to power the wireless transmitter produce a hall call signal; and a hall indicator module having a display, wherein the hall indicator module is wirelessly linked to the hall call switch module to receive the hall call signal from the wireless transmitter of the hall call switch module and wirelessly linked to the elevator control system to transmit hall call information to the elevator control system and to receive the elevator position signal from the elevator control system, wherein the display includes up and down button indicators that are controlled as a function of the hall call signal received from the hall call switch module and up and down hall car arrival indicators that are controlled as a function of the elevator position signal, and wherein the hall indicator module is physically spaced from the hall call switch module and has no wired connection to the hall call switch module.

6. The system of claim 5, wherein the hall call switch module does not include a display.

7. The system of claim 5 and further comprising:

a wireless RF communication system wirelessly linking the hall call switch module and the hall indicator module.

8. The system of claim 5 and further comprising:

a wireless communication system wirelessly linking the elevator control system and the hall indicator module.

9. The system of claim 5, wherein the indicator of the hall indicator module is a lamp.

10. The system of claim 5, wherein the up button indicator is adjacent the up hall car arrival indicator, and the down button indicator is adjacent the down hall car arrival indicator.

11. The system of claim 10, wherein the up button indicator surrounds the up hall car arrival indicator, and the down button indicator surrounds the down hall car arrival indicator.

12. An elevator call system comprising:

an elevator entryway;

an indicator module capable of providing elevator status information, wherein the indicator module is positioned in an area of the elevator entryway; and a wireless and batteryless call switch module located remote from the indicator module, the call switch module comprising:

a hall call button;

a wireless transmitter for transmitting a hall call signal to the indicator module; and a power generator responsive to pressure applied to the power generator by actuation of the hall call button to generate electrical power for powering the wireless transmitter; and an elevator control system capable of providing an elevator position signal;

wherein the indicator module is wirelessly linked to the call switch module to wirelessly receive the hall call signal;

wherein the indicator module is wirelessly linked to the elevator control system to wirelessly transmit hall call information to the elevator control system and wirelessly receive the elevator position signal from the elevator control system;

wherein the indicator module includes up and down button indicators that are controlled as a function of the hall call signal received wirelessly from the call switch module; and wherein the indicator module includes the up and down hall car arrival indicators that are controlled as a function of the elevator position signal received wirelessly from the elevator control system.

13. The system of claim 12, wherein the power generator includes a piezoelectric element for powering the wireless transmitter with electrical power generated by the piezoelectric element in response to pressure applied through actuation of the hall call button.

14. The system of claim 12, wherein the wireless communication system is an RF transceiver system.

15. The system of claim 12, wherein the elevator status information is provided as a binary visual indication.

16. The system of claim 12, wherein the call switch module does not include a display.

17. The system of claim 12, wherein the up button indicator is adjacent the up hall car arrival indicator, and the down button indicator is adjacent the down hall car arrival indicator.

18. The system of claim 17, wherein the up button indicator surrounds the up hall car arrival indicator, and the down button indicator surrounds the down hall car arrival indicator.

* * * * *